US008272905B2

(12) United States Patent
Yang et al.

(10) Patent No.: US 8,272,905 B2
(45) Date of Patent: Sep. 25, 2012

(54) STRUCTURE FOR A TERMINAL IN AN ELECTRIC CONNECTOR

(75) Inventors: Yuchen Yang, Shanghai (CN); Andre E Guanco, Royal Oak, MI (US)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 12/927,946

(22) Filed: Nov. 30, 2010

(65) Prior Publication Data

US 2011/0130050 A1 Jun. 2, 2011

(30) Foreign Application Priority Data

Dec. 1, 2009 (CN) ..... 2009 1 0258032

(51) Int. Cl.
*H01R 4/48* (2006.01)

(52) U.S. Cl. ..... 439/816

(58) Field of Classification Search ..... 439/816, 439/441, 834–835, 728, 828
See application file for complete search history.

(56) References Cited

U.S. PATENT DOCUMENTS 6,004,168 A * 12/1999 Fuchs et al. ..... 439/835
7,131,857 B2 * 11/2006 Mueller ..... 439/441
7,607,956 B2 * 10/2009 Lang et al. ..... 439/835
* cited by examiner

*Primary Examiner* — Jean F Duverne
(74) *Attorney, Agent, or Firm* — Faegre Baker Daniels LLP

(57) ABSTRACT

The present invention relates to a field of electric connector, and in particular, to a structure for a terminal in an electric connector. In one preferred embodiment, a structure for a terminal in an electric connector is provided. The structure comprises: a terminal fixation part; a terminal elastic part; and an overstress prevention element. The terminal elastic part is extended from the terminal fixation part, wherein the terminal elastic part enables elastic deformation relative to the terminal fixation part and is configured to bend toward the terminal fixation part upon application of an external force. The overstress prevention element is provided between the terminal fixation part and the terminal elastic part, and is adapted for restricting overbending of the terminal elastic part. Furthermore, the present invention provides an electric connector incorporating the structure for the terminal therein. According to the present invention, the structure for a terminal in an electric connector realizes an overstress preventing performance. Furthermore, the structure for the terminal in the electric connector is compact in structure, has high efficiency in material utilization and low cost, and enables precise control of the stress on the structure for the terminal.

20 Claims, 2 Drawing Sheets

Fig. 2[a]

STRUCTURE FOR A TERMINAL IN AN ELECTRIC CONNECTOR

CROSS-REFERENCE TO RELATED APPLICATION

This application claims the benefit of Chinese Patent Application No. 200910258032.0 filed on Dec. 1, 2009 in the State Intellectual Property Office of China, the disclosure of which is incorporated herein by reference.

BACKGROUND OF THE INVENTION

1. Field of the Invention

The present invention relates to a field of electric connector, and in particular, to a structure for a terminal of an electric connector.

2. Description of the Related Art

It has been known that in an electric connector in the prior art, the terminal sheet generally provides a locking force or a retention force for the connection or the contact between the terminals sheet. In general, the terminal sheet usually adopts a cantilevered beam structure, such as a beam.

With the reference of FIG. 1*a* and FIG. 1*b*, they schematically illustrate the characteristics of the beam structure. FIG. 1*a* shows a basic mechanical schematic view of a cantilever beam having one fixed end, meanwhile a flexural moment distribution map of the cantilever beam with one end under an external force F is shown. As shown in FIG. 1*a*, the fixed end of the beam bears the maximum flexural moment T. And, FIG. 1*b* shows the continuous stress distribution on the whole beam under the external force F, in which the fixed end of this beam bears a maximum stress. From these figures, based on the mechanical characteristics of the beam structure, the fixed end of the beam bears the maximum flexural moment, accordingly, the deformation tolerance and the endurance stress limit of the whole beam depend on the endurance stress limit of the fixed end of the beam.

According to the above-mentioned mechanical principle of the cantilevered beam, there is an uneven stress distribution on an ideal beam of constant cross-section (as shown in FIG. 2*a*), that is to say, some parts of this ideal beam are useless for the stress. In an electric connector, the thickness of the beam-type terminal sheet usually remains unchanged because the terminal is made of a single piece of sheet-metal material. That is to say, it is unfeasible to change the stress distribution on the beam-type terminal sheet by varying the thickness of such terminal sheet.

Furthermore, in the design of this beam, the even stress distribution may be achieved by varying the width of such beam (as shown in FIG. 2*b*). This, however, improves merely the tolerance, of deformation of the beam, without helping to improve the stress characteristics of the beam. At the same time, in an electric connector, the beam-type terminal sheet should have certain width to ensure enough contact area to form a stable electrical connection. Therefore, there is a contradiction between reducing the width of the free end of the beam and increasing effective contact area of the terminal. Thus, it is also unfeasible to adopt the above-mentioned method of improving the stress distribution on the beam by varying the width of such beam in the electric connector.

SUMMARY OF THE INVENTION

The present invention has been made to overcome or alleviate at least one aspect of the above mentioned disadvantages.

Accordingly, it is an object of the present invention to provide a structure for preventing the overstress in a terminal of an electric connector.

Accordingly, it is another object of the present invention to provide a structure for a terminal in an electric connector, which is compact in structure, has high efficiency of material utilization and low cost, and enables precise control of the stress on the terminal.

Accordingly, it is another further object of the present invention to provide an electric connector with a terminal of the above-mentioned structure.

According to an aspect of the present invention, there is provided a structure for a terminal in an electric connector. The structure comprises: a terminal fixation part; a terminal elastic part extended from the terminal fixation part, wherein the terminal elastic part enables elastic deformation relative to the terminal fixation part and is configured to bend toward the terminal fixation part when under external force; and an overstress prevention element provided between the terminal fixation part and the terminal elastic part and adapted for restricting overbending of the terminal elastic part. According to the present invention, in the above structure for the terminal in the electric connector, the terminal elastic part for elastic deformation has an elastic deformation region which is supported by the overstress prevention element.

According to a preferred embodiment of the present invention, the overstress prevention element supports the deformed elastic deformation region of the terminal elastic part when the terminal elastic part engages with a mating terminal. It shall be noted that, as shown in FIG. 4 and FIG. 5, the deformed elastic deformation region may be a deformation part with arc cross-section.

Specifically, the terminal elastic part has: an upper surface adapted to be brought into contact with the mating terminal; and a lower surface adapted to be brought into contact with the overstress prevention element; wherein the overstress prevention element has a supporting surface adapted to be mated with the lower surface of the terminal elastic part. Furthermore, the supporting surface of the overstress prevention element at least supports the deformed elastic deformation region of the terminal elastic part. Preferably, the supporting surface may be embodied as a curved surface having a curvature in consistence with that of the lower surface of the deformed terminal elastic part. Alternatively, the supporting surface may be embodied as at least one arc brim.

Particularly, the structure for the terminal in the electric connector according to the present invention is made of metal material.

In one preferred embodiment, the overstress prevention element may be integrated with the terminal fixation part by a stamping or die-cut process. In another embodiment, the overstress prevention element may be integrated with the terminal fixation part by an injection molding process. In a further embodiment, the overstress prevention element may be an additional element independent from the terminal and is provided between the terminal fixation part and the terminal elastic part.

Meanwhile, the present invention further comprises an electric connector incorporating the above-mentioned structure for the terminal. The electric connector comprises: a terminal having the above structure; and an insulating housing in which the terminal is provided.

Refer to FIG. 3*a*, in the structure of a cantilevered beam, according to the structure of the bended beam (for example, the bended beam has a curved surface of certain curvature when under an external force), an assistant supporting feature is provided under the bended beam. The assistant supporting feature has a curved surface which mates with the curved surface of the bended beam. When being exerted an external force, the bended beam is completely supported on the mating curved surface of the supporting feature. Based on the mechanical principle of the beam structure, when the bended beam is fully supported by the curved surface of the supporting feature, so as to form an even stress distribution on the whole beam (including the fixed end and the free end thereof) as show in FIG. 3*b*. Thus, for the cantilevered beam, a maximum deformation tolerance and an increased endurance stress limit are achieved.

As apparent from the above, the structure for a terminal in an electric connector of the present invention at least has following advantages: based on the design principle of the above-mentioned cantilevered beam, an overstress prevention element is incorporated into the structure. By means of the overstress prevention element, an even stress distribution on the terminal may be achieved on the whole bended terminal elastic part of the structure for the terminal in the electric connector when under an external force. With the aid of the overstress prevention element, the terminal elastic part having the same size as that of the prior art can withstand a greater amount of deformation and higher external force.

Further, the structure for the terminal in the electric connector of the present invention can be incorporated into an electric connector so as to achieve an overstress preventing performance. Moreover, the structure for the terminal according to the present invention is compact in structure, has high efficiency in material utilization and low cost, and enables precise control of the stress on the terminal.

BRIEF DESCRIPTION OF THE DRAWINGS

These and/or other aspects and advantages of the invention will become apparent and more readily appreciated from the following description of the embodiments, taken in conjunction with the accompanying drawings of which:

FIGS. 1*a* and 1*b* are schematic views which illuminate a mechanical principle of a cantilevered beam, respectively, in which FIG. 1*b* shows stress distribution state on a whole bended beam;

FIGS. 2*a* and 2*b* are schematic views showing a solution of an even stress distribution on a beam in the prior art, respectively;

FIGS. 3*a* and 3*b* are schematic views showing a design principle of the present invention, respectively, in which FIG. 3*b* shows stress distribution state on a beam which adopts the structure of the present invention;

DETAILED DESCRIPTION

Figure 1A:
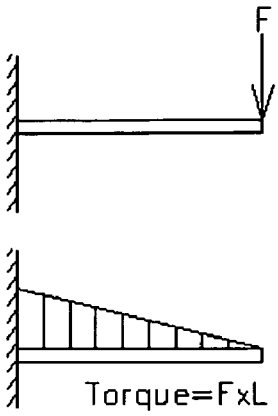
Figure 1B:
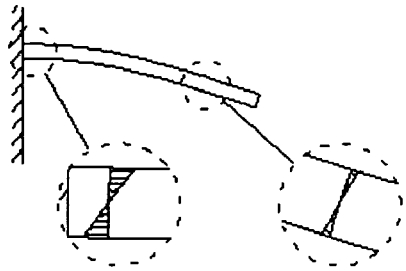
Figure 2B:
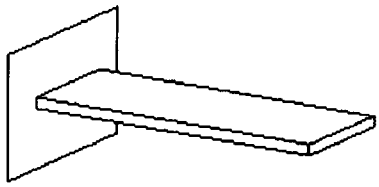
Figure 2B:
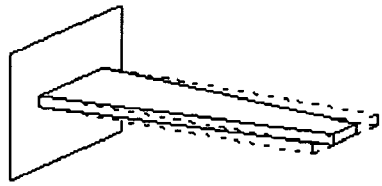
Figure 3A:
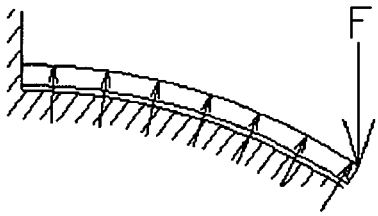
Figure 3B:
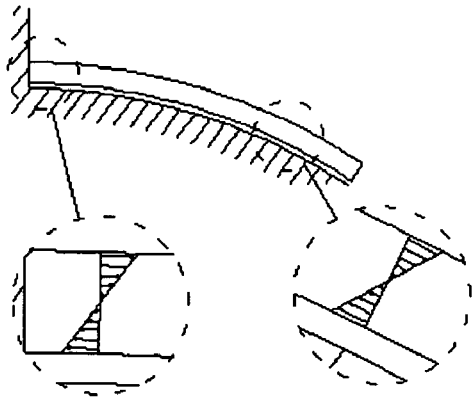

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

For easier understanding, hereafter are the detailed descriptions and illustrations about the present invention by taking the structure for a terminal in an electric connector as an example. Particularly, the electric connector mainly comprises an insulating housing and a terminal provided in the insulating housing and adapted for electrical connection. The terminal has a splicing portion to be mated with a mating terminal of the mating electric connector. The structure for a terminal in an electric connector is mainly employed on the splicing portion of the terminal.

Figure 4:
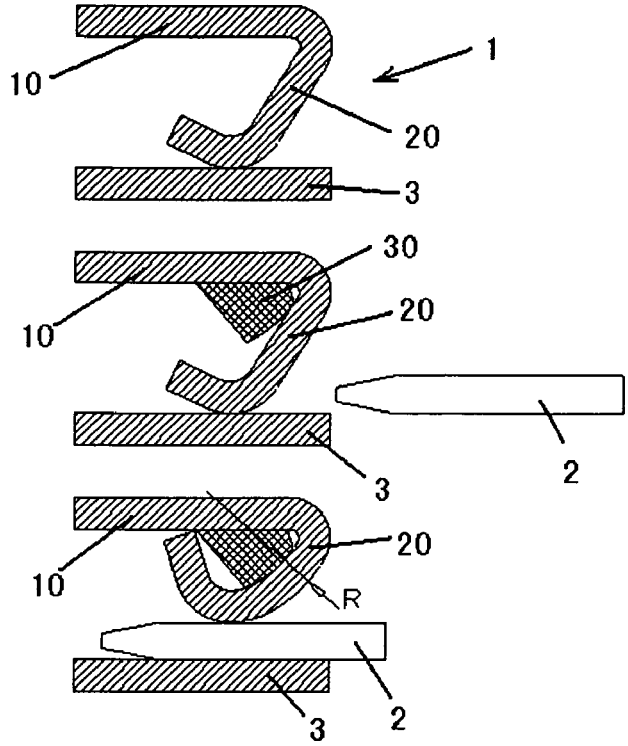
FIG. 4 is a schematic view showing a structure for a terminal in an electric connector according to the preferred embodiment of the present invention, illustrating the conditions of the structure for the terminal before and after being stressed.
Figure 5:
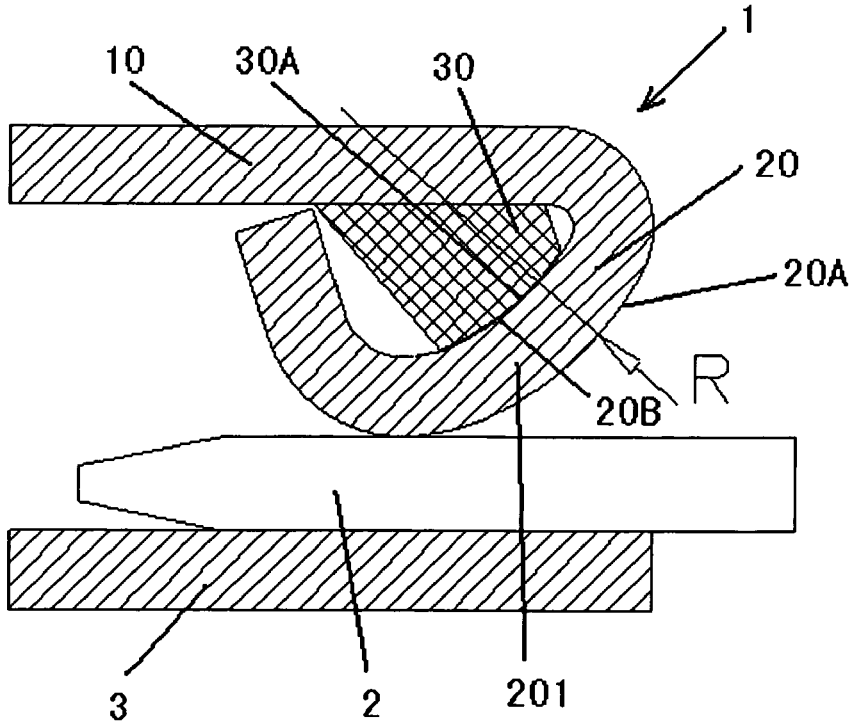
FIG. 5 is an enlarged schematic view showing a structure for a terminal in an electric connector according to the preferred embodiment of the present invention, mainly illustrating the conditions of the structure for the terminal after being stressed.

FIG. 4 and FIG. 5 show a portion of an electric connector according to the preferred embodiment of the present invention, respectively. Specifically, FIG. 4 mainly shows a portion of a structure for a terminal in an electric connector according to the present invention, especially in the conditions of the structure for the terminal before and after being stressed; and, FIG. 5 mainly shows a portion of a structure for a terminal in an electric connector in the conditions of the structure for the terminal after being stressed. In FIG. 4 and FIG. 5, for easier description, number 1 represents both a terminal in an electric connector and a structure for a terminal according to the present invention; number 2 represents both a mating electric connector which engages with the electric connector and a terminal (i.e., an external terminal) of the mating electric connector; and number 3 represents an insulating housing of the electric connector and a side wall of the insulating housing, in which the terminal of the mating electric connector exerts a force, upon the cooperation with the side wall of the insulating housing, on the structure for the terminal in the electric connector when the electric connector and the mating electric connector are engaged with each other. In addition, according to the preferred embodiment, the terminal of the electric connector is embodied as a female terminal, and the terminal of the mating electric connector, which engages with the electric connector, is embodied as a male terminal.

As shown in FIG. 4 and FIG. 5, the present invention provides a structure 1 for a terminal in an electric connector. The structure 1 for a terminal in an electric connector comprises: a terminal fixation part 10; a terminal elastic part 20 extended from the terminal fixation part 10, and an overstress prevention element 30. The terminal elastic part 20 enables elastic deformation relative to the terminal fixation part 10. The terminal elastic part 20 is configured to bend toward the terminal fixation part 10 when it is urged by an external force. The overstress prevention element 30 is provided between the terminal fixation part 10 and the terminal elastic part 20 and is adapted for restricting over-bending of the terminal elastic part 20. Particularly, the terminal fixation part 10 and the terminal elastic part 20 are formed into one piece, and they are made of metal material with good conductivity. An angle is formed between the terminal fixation part 10 and the terminal elastic part 20. Preferably, the un-deformed terminal elastic part 20 is brought to in contact with a side wall of the insulating housing 3 when no external force is exerted thereupon.

The terminal elastic part 20 for elastic deformation has an elastic deformation region 201 upon application of an external force. The overstress prevention element 30 is provided to at least support the elastic deformation region 201. The elastic deformation region 201 of the terminal elastic part 20 has a maximum deformation point R, which is close to the terminal fixation part 10. The location of the maximum deformation point R may be achieved by a conventional method of material mechanics. According to the present invention, the overstress prevention element 30 at least supports the elastic deformation region 201 of the terminal elastic part 20. Of course, the overstress prevention element 30 necessarily supports the maximum deformation point R, so that the ultimate stress value of this point is effectively increased, and consequently, the allowable deformation value of the terminal elastic part 20 is increased. According to the preferred embodiment, as shown in FIG. 4, when the terminal elastic part 20 is brought into being engaged with the external terminal 2, i.e., when the terminal elastic part 20 deforms under the action of the force from the external terminal 2, the overstress prevention element 30 supports not only the maximum deformation point R of the terminal elastic part 20, but also the deformed elastic deformation region 201 of the terminal elastic part 20. Thus, in conjunction with the above-mentioned design principle of the beam structure, by adopting the overstress prevention element 30 supporting the deformed elastic deformation region 201 of the terminal elastic part 20, the stress on the deformed elastic deformation region 201 of the terminal elastic part 20 is even. Thus, the terminal elastic part 20 with same size in length achieves an improved maximum deformation tolerance and an increased endurance stress limit, with the aid of the overstress prevention element 30.

Moreover, as shown in FIG. 5, the terminal elastic part 20 has an upper surface 20A to be mated with the external terminal 2 and a lower surface 20B opposite to the upper surface 20A. Also, the overstress prevention element 30 has a supporting surface 30A which is mated with the lower surface 20B. It is worthy being mentioned that, as shown in FIG. 4 and FIG. 5, the deformed elastic deformation region 201 may be a region 201 having an arc-shaped cross-section. According to the preferred embodiment, when the terminal elastic part 20 is a flat one, the supporting surface 30A of the overstress prevention element 30 is preferably embodied as a smoothly curved surface having a curvature in consistence with that of the lower surface of the deformed terminal elastic part 20. Therefore, the deformed terminal elastic part 20 is brought into full contact with the supporting surface 30A of the overstress prevention element 30. By adopting the above configuration, the stress on the terminal elastic part 20 is more precisely controlled. Particularly, in one preferred embodiment, the supporting surface 30A of the overstress prevention element 30 at least supports the elastic deformation region 201 of the deformed terminal elastic part 20. Preferably, the supporting surface 30A of the overstress prevention element 30 is a complete curved surface having a curvature in consistence with that of the lower surface 20B of the deformed terminal elastic part 20. Alternatively, in another preferred embodiment, the supporting surface 30A may be embodied as at least one arc edge. For example, in the case that the overstress prevention element 30 is formed by applying a stamping process on the terminal fixation part 10, the supporting surface 30A of the overstress prevention element 30 is embodied as arc brims extended from both lateral sides of the terminal fixation part 10.

According to the present invention, the overstress prevention element 30 of the structure 1 for a terminal in an electric connector may be formed between the terminal fixation part 10 and the terminal elastic part 20 in any suitable manner. For example, in one preferred embodiment, the overstress prevention element 30 may be integrated with the terminal fixation part 10 by a stamping process. Alternatively, in another preferred embodiment, the overstress prevention element 30 may be integrated with the terminal fixation part 10 by an injection molding process. Also, the overstress prevention element 30 may be an additional element provided between the terminal fixation part 10 and the terminal elastic part 20.

According to the present invention, the structure for the terminal 1 which used in the electric connector is designed based on the mechanical principle of the beam structure. Moreover, the structure for the terminal has the advantages of compact in structure, high efficiency of material utilization, low cost, and precise control of the stress on the structure for the terminal.

Meanwhile, according to the present invention, when being deformed, the terminal which adopts the structure for the terminal has the stress thereon in an evenly distribution manner. Therefore, the ultimate stress value and the allowable deformation value of the terminal elastic part 20 are effectively increased. Moreover, the terminal which adopts the structure for the terminal according to the present invention is advantageous in compact structure, high efficiency in material utilization, low cost, and precise control of the stress on the structure for the terminal.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A structure for a terminal contact in an electric connector, the structure comprising:

a terminal fixation part;

a terminal elastic part extending from the terminal fixation part, said terminal elastic part having an elastic deformation region which is subjected to elastic deformation toward said terminal fixation part upon application of an external force; and an overstress prevention element provided between said terminal fixation part and said terminal elastic part, wherein said overstress prevention element is adapted to contact with at least a portion of said elastic deformation region after said elastic deformation region is elastically deformed and to restrict overbending of said terminal elastic part.

2. The structure according to claim 1, wherein: said overstress prevention element supports the deformed elastic deformation region of said terminal elastic part when said terminal elastic part engages with a mating terminal.

3. The structure according to claim 2, wherein said terminal elastic part has:

an upper surface adapted to be brought into contact with the mating terminal; and a lower surface adapted to be brought into contact with said overstress prevention element;

wherein said overstress prevention element has a supporting surface adapted to be mated with said lower surface.

4. The structure according to claim 3, wherein: said supporting surface of said overstress prevention element at least supports the deformed elastic deformation region of said terminal elastic part.

5. The structure according to claim 3, wherein: said supporting surface is embodied as a curved surface having a curvature consistent with that of said lower surface of said deformed terminal elastic part.

6. The structure according to claim 3, wherein: said supporting surface is embodied as at least one arc brim.

7. The structure according to claim 1, wherein the structure is made of metal material.

8. The structure according to claim 1, wherein: said overstress prevention element is integrated with said terminal fixation part by a stamping process.

9. The structure according to claim 1, wherein: said overstress prevention element is integrated with said terminal fixation part by an injection molding process.

10. The structure according to claim 1, wherein: said overstress prevention element is an additional element independent from said terminal and is provided between said terminal fixation part and said terminal elastic part.

11. An electric connector terminal, comprising:

a terminal contact comprising:

a terminal fixation part;

a terminal elastic part extending from the terminal fixation part, said terminal elastic part having an elastic deformation region which is subject to elastic deformation toward said terminal fixation part upon application of an external force; and an overstress prevention element provided between said terminal fixation part and said terminal elastic part; and an insulating housing in which said terminal contact is provided;

wherein said overstress prevention element is adapted to contact with at least a portion of said elastic deformation region, after said elastic deformation region is elastically deformed, and to restrict overbending of said terminal elastic part.

12. The electric connector terminal according to claim 11, wherein: said overstress prevention element supports the deformed elastic deformation region of said terminal elastic part when said terminal elastic part engages with a mating terminal.

13. The electric connector terminal according to claim 12, wherein said terminal elastic part has:

an upper surface adapted to be brought into contact with the mating terminal; and a lower surface adapted to be brought into contact with said overstress prevention element;

wherein said overstress prevention element has a supporting surface adapted to be mated with said lower surface.

14. The electric connector terminal according to claim 13, wherein: said supporting surface of said overstress prevention element at least supports the deformed elastic deformation region of said terminal elastic part.

15. The electric connector terminal according to claim 13, wherein: said supporting surface of said overstress prevention element has a curved surface having a curvature consistent with that of said lower surface of said deformed terminal elastic part.

16. The electric connector terminal according to claim 13, wherein: said supporting surface has at least one arc brim.

17. The electric connector terminal according to claim 11, wherein: said overstress prevention element is integrated with said terminal fixation part.

18. The electric connector terminal according to claim 11, wherein: said overstress prevention element is an additional element independent from said terminal and is provided between said terminal fixation part and said terminal elastic part.

19. An electric connector assembly, comprising:

a first terminal comprising:

a terminal fixation part;

a terminal elastic part extending from the terminal fixation part, said terminal elastic part having an elastic deformation region which is subject to elastic deformation toward said terminal fixation part upon application of an external force; and an overstress prevention element provided between said terminal fixation part and said terminal elastic part; and a second terminal comprising a pin part configured and adapted to electrically contact said terminal elastic part, when said first and second terminals are electrically connected with each other;

wherein said overstress prevention element is adapted to contact at least a portion of said elastic deformation region and restrict overbending of said terminal elastic part, after said first and second terminals are electrically connected with each other.

20. An electric connector assembly according to claim 19, wherein: said overstress prevention element is positioned between said terminal fixation part and said pin part.

* * * * *